United States Patent [19]

Strubel et al.

[11] 4,019,520

[45] Apr. 26, 1977

[54] TOBACCO SUBSTITUTE CONTAINING BORIC OXIDE, BORON OXYACIDS, AND AMMONIUM, ALKALI METAL, OR ALKALINE EARTH METAL SALTS OF BORON OXYACIDS

[75] Inventors: David G. Strubel, Jeffersontown; Robert R. Johnson, Louisville, both of Ky.

[73] Assignee: Brown & Williamson Tobacco Corporation, Louisville, Ky.

[22] Filed: Nov. 25, 1974

[21] Appl. No.: 527,175

[52] U.S. Cl. ..... 131/2; 131/17 AC

[51] Int. Cl.[2] ..... A24D 1/18

[58] Field of Search ..... 131/2, 4, 9, 17, 140, 131/15, 17 R

[56] References Cited

UNITED STATES PATENTS

| | | | |
|---|---|---|---|
| 1,879,128 | 9/1932 | Desper | 131/15 A |
| 2,114,281 | 4/1938 | Allen | 131/17 R |
| 2,329,927 | 9/1943 | Morton | 131/17 R |
| 3,076,728 | 2/1963 | Albert | 131/17 R |
| 3,459,195 | 8/1969 | Silberman | 131/17 |
| 3,477,865 | 11/1969 | Armbrust et al. | 131/17 R |
| 3,528,432 | 9/1970 | Stossel | 131/4 A |
| 3,608,560 | 9/1971 | Briskin et al. | 131/2 |
| 3,812,864 | 5/1974 | Cartwright | 131/2 |
| 3,818,915 | 6/1974 | Anderson | 131/17 R |

FOREIGN PATENTS OR APPLICATIONS

| | | | |
|---|---|---|---|
| 1,157,574 | 8/1969 | United Kingdom | 131/140 C |

OTHER PUBLICATIONS

"Temperature–Yield Profiles of Tobacco and Tobacco Constituents I" by Benner et al. published by Dept. of Agronomy, University of Kentucky, Lexington Ky. et al. 8/1969.

*Primary Examiner*—Robert W. Michell
*Assistant Examiner*—V. Millin
*Attorney, Agent, or Firm*—William J. Mason

[57] ABSTRACT

Tobacco substitutes comprising an organic binder containing boric oxide or boron oxyacids and their ammonium, alkali metal and alkaline earth metal salts are disclosed. The disclosed tobacco substitute may comprise from about 2 to about 95% by weight boric oxide, boron oxyacid, or boron oxyacid salt and from about 5 to about 50% by weight, of the organic binder wherein during combustion the boron compound melts or fuses to form a stable ash. The tobacco substitute may also optionally include up to about 93% by weight of a filler such as $CaCO_3$, $MgCO_3$, charcoal, alumina or alumina trihydrate and up to about 15% by weight monoammonium or diammonium phosphate.

33 Claims, No Drawings

TOBACCO SUBSTITUTE CONTAINING BORIC OXIDE, BORON OXYACIDS, AND AMMONIUM, ALKALI METAL, OR ALKALINE EARTH METAL SALTS OF BORON OXYACIDS

FIELD OF INVENTION

The present invention relates to a tobacco substitute material. More specifically, the present invention pertains to a tobacco substitute comprising an organic binder containing boric oxide, a boron oxyacid, or a boron oxyacid salt. The tobacco substitute may also contain an inorganic filler such as alumina trihydrate, $CaCO_3$, $MgCO_3$ and charcoal and/or monoammonium phosphate or diammonium phosphate.

BACKGROUND OF THE INVENTION

Tobacco substitute or synthetic smoking materials have been known for some time. Such materials, which may be included in smoking articles as the sole smokeable material or in admixture with natural tobacco, may be employed for economic reasons, or to affect the composition of the smoke resulting from a smokeable article.

Numerous tobacco substitutes are known; typical tobacco substitutes are described in, e.g., U.S. Pat. Nos. 2,809,904; 3,410,276; 3,461,879; 3,477,865; and 3,732,392. Typically, such tobacco substitutes comprise a binder, a fibrous filler, such as asbestos or kraft pulp, to impart strength to the tobacco substitute sheet; and a combustion control or burning rate modifying agent. In some instances, substitutes may also require an ash control agent.

Tobacco substitutes desirably have a number of properties which are analogous to those of natural tobacco. For example, tobacco substitutes should have burning characteristics which are compatible with natural tobacco. Some otherwise suitable tobacco substitute compositions burn too rapidly or at too high a temperature to be suitable for use as smokeable items. In order to overcome this disadvantage, constituents such as hydrated alumina have been incorporated into the reconstituted tobacco as combustion control or burning rate control agents.

Another problem with many tobacco substitute compositions is that a coherent ash is not formed. Instead of forming a coherent ash, the ash tends to flow off. This, of course, results in an unsatisfactory smokeable product. Various materials are known to affect ashing properties, and in some instances, fibrous materials have served both to support the ash after combustion and to impart strength to the substitute sheet. Fibrous materials used to support tobacco substitute ash include asbestos or cellulosic materials, such as cellulose gauze treated with a flameproofing agent.

The present invention pertains to tobacco substitutes produced in the form of coherent sheets which can be subsequently shredded into a form suitable for use in smokeable products. The product of the present invention, in admixture with tobacco, has a burn rate which is suitable for use in a smokeable product. In addition, the compositions of the present invention, upon combustion, form a stable ash without requiring the use of undesirable fibrous reinforcing agents. Furthermore, the tobacco substitutes of the present invention do not impart undesirable taste to smokeable products, and may be economically produced.

SUMMARY OF THE INVENTION

The present invention pertains to tobacco substitutes comprising an organic binder containing boric oxide, boron oxyacids, or ammonium, alkali metal, or alkaline earth metal salts or boron oxyacids. These tobacco substitutes may be employed in admixture with natural tobacco in amounts up to 50% by weight, preferably about 3 to about 50% by weight.

The tobacco substitutes of the present invention comprise from about 2 to about 95% by weight of boric oxide, a boron oxyacid, or an ammonium, alkali metal, or alkaline earth metal salt of a boron oxyacid; from about 5 to about 50% by weight of an organic binder; and from 0 to 93% by weight or an inorganic filler selected from the group consisting of alumina, alumina trihydrate, magnesium carbonate, calcium carbonate and charcoal.

In accordance with one embodiment of the present invention, a tobacco substitute is provided comprising from about 75 to about 95% by weight, and preferably about 75 to about 85% by weight of boric oxide, a boron oxyacid, or an ammonium, alkali metal or alkaline earth metal salt of a boron oxyacid; and from about 5 to about 25%, and preferably from about 10 to about 20% by weight of an organic binder.

In accordance with another embodiment of the present invention, a tobacco substitute is provided comprising from about 2 to about 25% by weight, and preferably from about 5 to about 20% by weight of boric oxide, a boron oxyacid, or an ammonium, alkali metal or alkaline earth metal salt of a boron oxyacid; from about 40 to about 93% by weight, and preferably from about 50 to about 80% by weight, an inorganic filler selected from the group consisting of alumina, alumina trihydrate, magnesium carbonate, calcium carbonate, and charcoal; and from about 5 to about 35% by weight and preferably from about 10 to about 30% by weight of an organic binder. A particularly preferred embodiment includes about 5 to about 15% by weight of the boron compound; about 70 to about 80% by weight of the inorganic filler, and about 10 to about 20% of the binder.

The tobacco substitute of the present invention also may optionally include up to about 15% by weight monoammonium phosphate or diammonium phosphate. Preferably, the substitutes contain up to about 10% phosphate, e.g., about 3 to about 10%.

DESCRIPTION OF PREFERRED EMBODIMENTS

In the tobacco substitutes of the present invention, boric oxide; a boron oxyacid; or an ammonium, alkali metal, or alkaline earth salt of a boron oxyacid may function as the basic tobacco substitute filler and/or as a burn and ash control additive. During combustion of a smokeable product containing the tobacco substitute, the boric oxide, boron oxyacid, or boron oxyacid salt melts or fuses to form a stable ash. When other fillers are included within the tobacco substitute, the boric oxide, boron oxyacid, or boron oxyacid salt serve to bind the combustion residue of these fillers insuring a stable ash.

A large number of different boron oxyacids or boron oxyacid salts may be employed, as long as they do not produce obnoxious or toxic fumes when subjected to temperatures encountered during smoking. Specific examples of suitable compounds include boric acid ($H_3BO_3$), metaboric acid ($HBO_2$), pyroboric acid ($H_2B_4O_7$), borax ($Na_2B_4O_7.10H_2O$), sodium tetraborate ($Na_2B_4O_7$), sodium tetraborate pentahydrate ($Na_2B_4O_7.5H_2O$), sodium metaborate ($NaBO_2 \cdot 4H_2O$), potassium metaborate ($KBO_2$), potassium tetraborate ($K_2B_4O_7.5H_2O$), lithium metaborate dihydrate ($LiBO_2.2H_2O$), lithium tetraborate ($Li_2B_4O_7.5H_2O$), calcium metaborate [$Ca(BO_2)_2$] and hydrates thereof, calcium tetraborate ($CaB_4O_7$), magnesium orthoborate ($3MgO \cdot B_2O_3$), magnesium metaborate [$Mg(BO_2)_2.8H_2O$], magnesium pyroborate ($Mg_2B_2O_5.H_2O$), lithium metaborate ($LiBO_2.8H_2O$), lithium tetraborate ($Li_2B_4O_7.5H_2O$), ammonium tetraborate [$(NH_4)_2B_4O_7.4H_2O$] and ammonium pentaborate [$(NH_4)_2B_{10}O_{16} \cdot 8H_2O$]. Borax and boric acid are the preferred additives.

The tobacco substitutes of the present invention include an organic binder. A wide variety of natural or synthetic binders are suitable, provided they are not inimical to flavor and do not generate obnoxious or toxic fumes upon combustion. Specific examples of suitable binders include natural vegetable gums such as gum arabic, gum tragacanth, guar gum, locust bean gum, etc. Other suitable gums include carbohydrate gums from animal sources, such as glycogen, partially deacetylated chitin and the like, marine plant gums such as algins, carageenans, laminarins and agar; microbial gums, such as dextrans, phosphomannans, etc.; and proteins such as egg albumin, gluten, zein, etc. Starches such as starch ethers, starch esters, amylose, amylose pectin, and the like also may be employed. In addition, synthetic polymers, such as polyvinyl alcohol, polyvinyl acetate, polyoxyethylene, styrene-butadiene copolymers, etc. may be employed.

Preferred binders which are particularly useful in the tobacco substitutes of the present invention include the substituted cellulosic gums, such as cellulose ethers, cellulose esters, and mixtures thereof. Specific examples of such binders include methyl cellulose, ethyl cellulose, hydroxypropyl cellulose, methylhydroxyethyl cellulose, ethylhydroxyethyl cellulose, cellulose acetate, hydroxyethyl cellulose, sodium carboxymethylcellulose, etc.

A particularly preferred binder is methyl cellulose such as that sold commercially under the designation METHOCEL (Dow Chemical Co.) Type MC Grade Premium, 1500 cp viscosity. Another particularly preferred binder is a mixture of methyl cellulose and cellulose acetate.

Inclusion of cellulose acetate, along with methyl cellulose, in the binder results in an improvement in wet strength or waterproofing properties of the tobacco substitute sheet. The increase in wet tensile strength occurs with as little as 6% cellulose acetate (1 part cellulose acetate to 15 parts methyl cellulose) in the binder, and is observed up through a complete replacement of the methyl cellulose with cellulose acetate.

While the binder may be employed in amount of from about 5 to about 50%, it should be recognized that the amount employed in any specific formulation will depend on several factors. The amount of binder employed will depend not only upon the amount of other ingredients included, but also upon the specific nature of the other ingredients and the specific nature of the particular binder selected.

A small amount of a plasticizer is advantageously incorporated into the tobacco substitute sheets to improve flexibility. The specific plasticizer employed depends, of course, on the specific binder employed. Preferred plasticizers include polyhydric alcohols, for example, glycols such as glycerin, di- or triethylene glycol, or propylene glycol.

To enhance the appearance of the tobacco substitutes, a coloring agent may be incorporated therein. While the tobacco substitutes could be made most any color, preferably coloring agents are added which will impart a color similar to that of natural tobacco. Among the suitable coloring agents are those certified by the Food and Drug Administration.

Flavoring agents also may be incorporated into the tobacco substitute. Various natural botanical extracts, including tobacco extracts, may be employed to color and flavor the substitutes. Other flavoring agents which may be used include those typically used commercially to flavor tobacco, such as menthol, tonka bean, vanillin, etc.

In accordance with the present invention, an inorganic material, such as calcium carbonate, magnesium carbonate, charcoal, alumina or alumina trihydrate may be incorporated into the tobacco substitute as a filler. The preferred filler is alumina trihydrate. These hydrates of alumina, which may be represented by the formulas $Al_2O_3 \cdot 3H_2O$ or $Al(OH)_3$, are dry, free-flowing white crystalline products available in abundance from the Bayer or Bayer-sinter process. The combined water of these hydrates is releasable upon heating, starting at a temperature of about 150° C.

The particle size of the inorganic filler is not critical; a wide variety of particle sizes may be used with equal efficacy. However, with very small particles, it is preferred to include a wetting agent in the composition which is formed into the tobacco substitutes in order to insure that the particles are distributed throughout the binder and to prevent dusting.

One of the major problems encountered in using inorganic filler (particularly alumina) containing tobacco substitutes in smoking articles is "flaking" and falling of the ash when the smoking article is burning. In the tobacco substitutes of the present invention, the boron oxyacid or salt thereof, by themselves or in combination with monoammonium phosphate or diammonium phosphate, produces a good fused ash, thus obviating this problem.

As previously noted, the tobacco substitutes of the present invention may optionally include monoammonium phosphate or diammonium phosphate. The phosphates appear to somewhat enhance the ash fusing properties of the boric oxide, boron oxyacids or boron oxyacid salts. In addition, the phosphates are effective to improve smoke taste. It is believed that the inclusion of the phosphates results in the delivery of a small quantity of ammonia to the smoke. The ammonia at least partially overcomes the taste of some burning binders, in particular, cellulose base binders. Diammonium phosphate is slightly superior to monoammonium phosphate in masking the burning binder taste, and is thus slightly preferred by smokers.

The tobacco substitutes of the present invention may be prepared by mixing a binder with a solvent for the binder. If desired, a plasticizer for the binder may be included in the mixture. The amount of solvent and plasticizer used, of course, depend on the particular binder employed. Typically, for each part by weight of binder, at least 20 parts by weight of solvent are used, and the plasticizer is used in amounts of about 20% of the binder weight. The solvent mixture is agitated until a smooth, viscous, clear "dope" forms.

A boric oxide, a boron oxyacid or a salt of a boron oxyacid, and in some instances, an inorganic filler such as alumina trihydrate and/or monoammonium or diammonium phosphate are added to the dope. The mixture is then stirred until all solids are suspended. Alternatively, the additives may be added to the dope and the mixture ball milled to insure good distribution of the solids through the binder.

The mixture is cast on a stainless steel surface and the solvent is evaporated. The resultant sheet is a smooth, thin, flexible film. The film may be added to tobacco and processed normally to produce smoking articles.

The specific solvent system employed depends upon the specific binder employed. Water or various organic solvents may be used. Particularly good results have been obtained using a binder of methyl cellulose or a mixture of methyl cellulose and a cellulose acetate with a solvent comprising 4 parts by volume methylene chloride and one part by volume methanol.

Very satisfactory results with methyl cellulose binders also have been obtained using various 20% alcohol-80% water mixtures. Water-methanol, water-ethanol, and water-isopropanol systems all produce acceptable sheets. Water-n-butanol and water-n-propanol solvent systems have not resulted in a coherent sheet. Satisfactory sheets have been obtained using methyl cellulose and a water solvent containing a small amount, e.g., 5% by weight, of a wetting agent, such as hexadecanol.

The water-alcohol mixtures result in sheets which have a very soft, flexible feel. In addition, the water-alcohol mixtures produce sheets having improved wet strength over sheets in which water alone was used as a solvent.

The present invention will be further illustrated by the specific examples which follow. These examples are intended to illustrate preferred embodiments and are in no way limiting.

EXAMPLE I 30 grams of methyl cellulose are mixed in one liter of a methylene chloride-methanol (4 to 1) solvent. To this mixture, six grams of glycerine are added as a plasticizer. The mixture is then agitated until a smooth, viscous "dope" forms. A mixture of 150 grams of alumina trihydrate, 10 grams of borax and 10 grams of monoammonium phosphate are added to the "dope" and the mixture is stirred until all of the solids are suspended.

The total mixture is then cast on a stainless steel band and the solvent is evaporated. The resultant sheet is a smooth, thin film that is very flexible. The sheet may be then mixed with tobacco and processed to make smoking articles such as cigarettes. Cigarettes on smoking produce a mild, pleasant taste.

EXAMPLE II

Ten grams of methyl cellulose, 5 grams of cellulose acetate, and 3 grams of glycerine are dissolved in a mixture of 100 ml. of methanol and 400 ml. of methylene chloride. After the binders are dissolved, 80 grams of borax and 5 grams diammonium phosphate are added.

The total mixture is transferred to a laboratory ball mill containing ceramic balls and tumbled for 16 hours. The mixture is removed from the ball mill and cast on a stainless steel band, and the methylene chloride and methanol are allowed to evaporate. The resultant sheet is smooth, thin, and flexible.

The sheet is shredded and mixed with tobacco in a ratio of 25 parts by weight substitute to 75 parts by weight tobacco, and the tobacco substitute tobacco mixture is made into cigarettes. Upon smoking, the substitute in these cigarettes produced a firm, coherent ash and a mild, pleasant smoke taste.

EXAMPLE III

Eight pounds of sodium carboxymethylcellulose (Hercules grade 7LF) were dissolved in 200 lbs. of water in an agitated Groen tank. To this mixture, 1.6 lbs. of glycerin were added as a plasticizer. The mixture was then agitated until all of the sodium carboxymethylcellulose was dissolved. A mixture consisting of 2 lbs. of diammonium phosphate, 3 lbs. of sodium tetraborate decahydrate (borax) and one-half pound of FD&C color No. 5 was then added to the above mixture and agitated until dissolved. At this point, 26.4 lbs. of alumina trihydrate and 0.5 lbs. of burnt umber were added to the mixture and agitated until the solids were suspended.

The total mixture was cast on an endless stainless steel band and the water removed by applying steam under the band. The resultant sheet was smooth and flexible and had a color comparable to tobacco. The sheet was shredded, mixed with tobacco (25 parts by wt. substitute to 75 parts by wt. tobacco), and made into a cigarette. The cigarette on smoking produced a mild, pleasant taste.

Those skilled in the art will visualize many modifications and variations of the invention set forth above without departing from its spirit and scope. Accordingly, while the preferred embodiments of the invention have been described, it is understood that the invention is not confined to specifics set forth by way of illustration.

What is claimed is:

1. A tobacco substitute consisting essentially of:

a. from about 2 to about 95% by weight of a boron compound selected from the group consisting of boric oxide, a boron oxyacid, and ammonium, alkali metal, and alkaline earth metal salts of a boron oxyacid;

b. from about 5% to about 50% by weight of an organic binder; and c. up to 93% by weight of an inorganic filler selected from the group consisting of alumina, alumina trihydrate, magnesium carbonate, calcium carbonate, and charcoal d. wherein during combustion said boron compounds melts or fuses to form a stable ash.

2. The tobacco substitute of claim 1 which includes about 75 to about 95% of said boron compound.

3. The tobacco substitute of claim 1 which includes about 2 to about 25% of said boron compound.

4. The tobacco substitute of claim 1 which additionally includes up to about 15% of a material selected from the group consisting of monoammonium phosphate and diammonium phosphate.

5. The tobacco substitute of claim 1 in which said boron compound is borax.

6. The tobacco substitute of claim 5 in which said inorganic filler is alumina trihydrate.

7. A smoke article comprising tobacco blended with up to about 50% of the tobacco substitute of claim 6.

8. The tobacco substitute of claim 1 in which said boron compound is boric acid.

9. The tobacco substitute of claim 1 in which said inorganic filler is alumina trihydrate.

10. The tobacco substitute of claim 1 in which said binder is selected from the group consisting of methyl cellulose, cellulose acetate, and mixtures thereof.

11. A smoke article comprising tobacco blended with up to about 50% of the tobacco substitute of claim 1.

12. A tobacco substitute comprising:

a. from about 75% to about 95 by weight of a boron compound selected from the group consisting of boric oxide, a boron oxyacid, and ammonium, alkali metal, and alkaline earth metal salts of a boron oxyacid;

b. up to about 15% by weight of a material selected from the group consisting of monoammonium phosphate or diammonium phosphate; and c. from about 5 to about 25% by weight of an organic binder, d. wherein during combustion said boron compounds melts or fuses to form a stable ash.

13. The tobacco substitute of claim 12 which contains from about 75 to about 85% by weight of said boron compound and from about 10 to about 20% by weight of said organic binder.

14. The tobacco substitute of claim 13 which contains up to about 10% by weight of a material selected from the group consisting of monoammonium phosphate or diammonium phosphate.

15. The tobacco substitute of claim 12 in which said boron compound is borax.

16. A smoke article comprising tobacco blended with the from about 5 to about 50% of the tobacco substitute of claim 15.

17. The tobacco substitute of claim 15 which contains from about 3 to about 10% by weight diammonium phosphate.

18. The tobacco substitute of claim 12 in which said boron compound is boric acid.

19. The tobacco substitute of claim 12 in which said binder is selected from the group consisting of methyl cellulose, cellulose acetate and mixtures thereof.

20. A smoke article comprising tobacco blended with the from about 5 to about 50% of the tobacco substitute of claim 12.

21. A tobacco substitute comprising:

a. from about 2 to about 25% by weight of a boron compound selected from the group consisting of boric oxide, a boron oxyacid, and ammonium, alkali metal, and alkaline earth metal salts of a boron oxyacid;

b. from about 40 to about 93% by weight of an inorganic filler selected from the group consisting of alumina, alumina trihydrate, magnesium carbonate, calcium carbonate, and charcoal;

c. up to about 15% by weight of a material selected from the group consisting of monoammonium phosphate or diammonium phosphate; and d. from about 5 to about 35% by weight of an organic binder e. wherein during combustion said boron compound melts or fuses to form a stable ash.

22. The tobacco substitute of claim 21 which contains from about 70 to about 80% by weight of said inorganic filler, from about 5 to about 15% by weight of said boron compound, and from about 10 to about 20% by weight of said organic binder.

23. The tobacco substitute of claim 22 which contains up to about 10% by weight of said material selected from the group consisting of monoammonium phosphate or diammonium phosphate.

24. The tobacco substitute of claim 21 in which said boron compound is borax.

25. The tobacco substitute of claim 24 which contains from about 3 to about 10% by weight of diammonium phosphate.

26. The tobacco substitute of claim 24 in which said inorganic filler is alumina trihydrate.

27. A smoke article comprising tobacco blended with the from about 5 to about 50% of the tobacco substitute of claim 26.

28. The tobacco substitute of claim 21 in which said boron compound is boric acid.

29. The tobacco substitute of claim 21 in which said inorganic filler is alumina trihydrate.

30. The tobacco substitute of claim 21 in which said binder is selected from the group consisting of methyl cellulose, cellulose acetate, and mixtures thereof.

31. A smoke article comprising tobacco blended with the from about 5% to about 50% of the tobacco substitute of claim 21.

32. The tobacco substitute of claim 21 which contains from about 5 to about 20% of said boron compound; from about 50 to about 80% of said inorganic filler; and from about 10 to about 30% by weight of said organic binder.

33. The tobacco substitute of claim 32 in which said binder is sodium carboxymethylcellulose.

* * * * *